US009722343B2

(12) United States Patent
Lappoehn

(10) Patent No.: US 9,722,343 B2
(45) Date of Patent: Aug. 1, 2017

(54) PLUG-IN CONNECTOR

(71) Applicant: ERNI Production GmbH & Co. KG, Adelberg (DE)

(72) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 15/121,835

(22) PCT Filed: Feb. 18, 2015

(86) PCT No.: PCT/DE2015/100066

§ 371 (c)(1),
(2) Date: Aug. 26, 2016

(87) PCT Pub. No.: WO2015/127926

PCT Pub. Date: Sep. 3, 2015

(65) Prior Publication Data

US 2017/0077637 A1 Mar. 16, 2017

(30) Foreign Application Priority Data

Feb. 28, 2014 (DE) ..... 10 2014 002 669

(51) Int. Cl.
*H01R 13/432* (2006.01)
*H01R 13/436* (2006.01)
*H01R 43/16* (2006.01)

(52) U.S. Cl.
CPC ..... *H01R 13/432* (2013.01); *H01R 13/4361* (2013.01); *H01R 43/16* (2013.01)

(58) Field of Classification Search
CPC ..... H01R 13/114; H01R 13/432
(Continued)

(56) References Cited

U.S. PATENT DOCUMENTS 3,697,934 A * 10/1972 Merry ..... H01R 13/428 439/748
3,711,819 A * 1/1973 Matthews ..... H01R 13/11 439/682

(Continued)

FOREIGN PATENT DOCUMENTS

DE 20 2006 010 308 U1 11/2006
DE 10 2010 024525 A1 12/2011

(Continued)

OTHER PUBLICATIONS

International Search Report of PCT/DE2015/100066, mailed Jun. 11, 2015.

*Primary Examiner* — Neil Abrams
(74) *Attorney, Agent, or Firm* — Collard & Roe, P.C.

(57) ABSTRACT

What is described is a plug-in connector comprising a housing and at least one chamber for receiving at least one electrical contact element that can be attached via a locking element inside the housing, wherein the locking element is a locking hook arranged at the contact element, wherein the locking hook can be latched in inside the housing in an opening that is adjusted to it, wherein the at least one contact element is a spring contact element, with its spring contacts being formed as legs of a sheet metal that is bent into a U-shape, characterized in that the snap-in element is arranged in a lid-like manner above the sheet metal bent into a U-shape, and namely in such a manner that it reaches up to the front area of the spring contacts.

8 Claims, 5 Drawing Sheets

(58) Field of Classification Search
USPC ..... 439/746–749
See application file for complete search history.

(56) References Cited

U.S. PATENT DOCUMENTS

| | | | | | |
|---|---|---|---|---|---|
| 3,853,389 | A * | 12/1974 | Occhipinti | H01R 13/114 | 439/747 |
| 3,932,013 | A * | 1/1976 | Yeager | H01R 13/114 | 439/510 |
| 4,379,611 | A | 4/1983 | Foege et al. | | |
| 6,106,339 | A * | 8/2000 | Nagai | H01R 13/432 | 439/744 |
| 6,186,837 | B1 * | 2/2001 | Abe | H01R 13/432 | 439/746 |
| 7,255,611 | B2 * | 8/2007 | Kubo | H01R 13/03 | 439/748 |
| 8,870,607 | B2 | 10/2014 | Lappoehn | | |
| 2017/0077637 | A1 * | 3/2017 | Lappoehn | H01R 13/432 | |

FOREIGN PATENT DOCUMENTS

| | | | |
|---|---|---|---|
| DE | 10 2010 034789 | B3 | 12/2011 |
| WO | 2006/055706 | A1 | 5/2006 |

* cited by examiner

PLUG-IN CONNECTOR

CROSS REFERENCE TO RELATED APPLICATIONS

This application is the National Stage of PCT/DE2015/100066 filed on Feb. 18, 2015, which claims priority under 35 U.S.C. §119 of German Application No. 10 2014 002 669.8 filed on Feb. 28, 2014, the disclosure of which is incorporated by reference. The international application under PCT article 21(2) was not published in English.

The invention relates to a plug-in connector comprising a housing and at least one chamber for the reception of at least one electrical contact element which can be attached via a locking element inside the housing, wherein the locking element is a locking hook that is arranged at the contact element and that can be locked in place inside the housing in an opening adjusted to that locking hook.

STATE OF THE ART

A plug-in connector with a secondary locking device follows from DE 20 2006 010 308 U1 for example. In this plug-in connector, which has at least one contact element that is arranged in the base element of the plug-in connector, at least one secondary locking recess is provided which is arranged inside the contact element in an oblique orientation with respect to the mating direction, and with which a locking cam of a secondary locking element meshes in the locking position of the secondary locking element. The contact element is embodied as a spring contact element. To facilitate the attachment inside the housing, it is provided that a locking hook, which meshes with a corresponding locking opening inside the housing, is arranged on a U-shaped connecting plate which connects the two spring contacts. This locking hook is punched out from the U-shaped connecting plate. The locking hook protrudes from the U-shaped connecting plate in a spring-like manner and in its latched state meshes with the opening inside the housing, thus holding the spring contact element, formed by both spring contacts and the U-shaped connecting plate, inside the housing. Such an attachment allows only limited tensile forces. Moreover, it renders the mounting process laborious. Also, the manufacture of the locking hook as a hook punched out from the U-shaped connecting plate involves a considerable amount of work.

DISCLOSURE OF THE INVENTION

Advantages of the Invention

In contrast to the plug-in connector known from the state of the art, in the plug-in connector according to the invention the snap-in element is not arranged in the U-shaped connecting plate between the spring contacts and on the side that is facing away from the spring contacts, but rather above the spring contacts, and namely in such a manner that the snap-in element is arranged in a lid-like manner above the sheet metal which is bent in a U-shape, wherein it also reaches up to the front area of the spring contact. Such a formation does not only allow for easier and faster manufacture, but also makes it possible to design the snap-in element with a larger size. Since the snap-in element juts out to beyond the spring contacts in a lid-like manner, as it were, it can be designed to be wider, and due to this fact as well as to its arrangement above the spring contact, it also facilitates a considerably higher resistance against extraction forces as compared to the snap-in element arranged in the U-shaped connecting plate. Advantageous further developments are the subject matter of the dependent subclaims. So it is provided, for example, that the snap-in element has a locking hook, with its bending area being formed on that side of the spring contacts which is facing the contact openings. In this way, the locking hook is arranged in the area of the contact openings.

Preferably, the bending area is wider than the snap-in element. Thereby, higher bending forces and enhanced stability are made possible.

In order to provide a better stability and to minimize the danger of the long hook itself being bent, it is further preferably provided that the snap-in element has a beading that substantially extends across its entire length.

Moreover, it is advantageously provided that the spring contacts, on the side that is facing the snap-in element, have an obliquely positioned supporting surface for the locking hook in its unengaged state. Thus, the snap-in element rests, as it were on the spring contacts up to the point where it is latched into the locking opening provided for that purpose. This supporting surface restricts the bending angle of the snap-in element in a very advantageous manner, thus avoiding that the snap-in element is damaged through overbending.

On the side that is facing the spring contacts, the snap-in element itself has a supporting surface for a knife-blade contact element. In the mated state of the knife-blade contact element and the spring contact element, any unlatching of the locking hook out of the locking opening is avoided since the supporting surface rests on the knife-blade contact element, with its cuboid-shaped exterior shape being formed at the opening of the U-shaped cross-section of the spring contact element, which is closed by the "lid", that is the snap-in element.

In addition, such a plug-in connector may also have a secondary locking device, such as is described in DE 20 2006 010 308 U1. Through the arrangement of the snap-in element above the spring contact elements, such a secondary locking device may at the same time be secured against unlocking in a very advantageous manner, since the snap-in element simultaneously avoids any actuation of the secondary locking device.

Preferably, it is provided that the spring contact element and the snap-in element are formed integrally with each other. With regard to easy manufacturing, the spring contact element and the snap-in element are formed from a single punched part and are bent multiple times.

SHORT DESCRIPTION OF THE DRAWINGS

Exemplary embodiments of the invention are shown in the drawings and are described in more detail in the following description.

DESCRIPTION OF THE EXEMPLARY EMBODIMENTS

Figure 1:
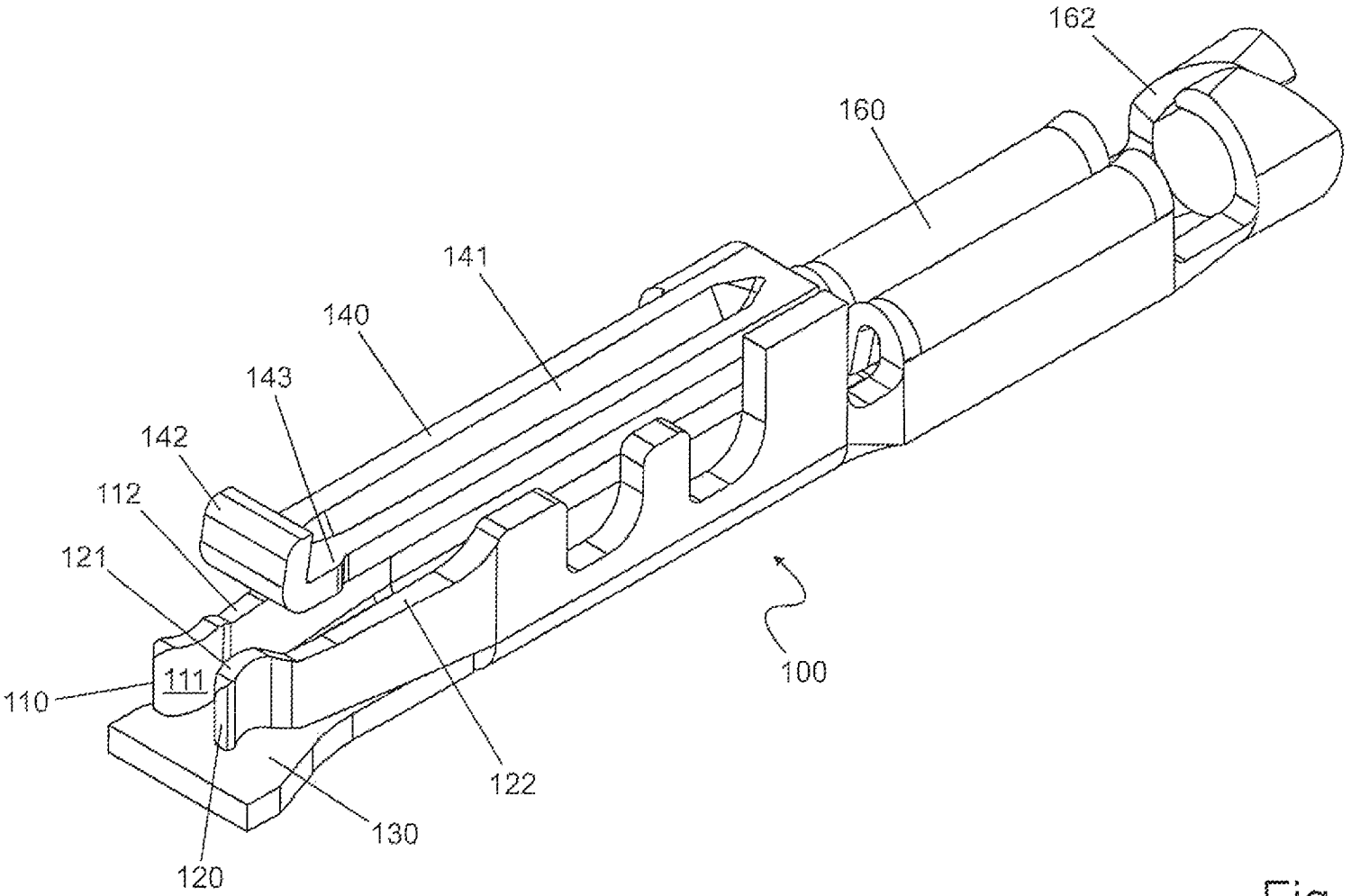
FIG. 1 is an isometric rendering of a spring contact element of a plug-in connector according to the invention.

A spring contact element of a plug-in connector according to the invention, which is termed 100 in its entirety, comprises two contact elements that are embodied as spring contacts 110, 120 in FIG. 1. These spring contacts 110, 120 serve for receiving a knife-blade contact element (see FIG. 6) in a manner that is per se known. The spring contacts 110, 120 are connected to each other via a connecting plate 130, wherein together with the connecting plate 130 the two spring contacts 110, 120 have a U-shape. This U-shaped arrangement is covered by a snap-in element 140 in a lid-like manner, as it were, so that, together with this lid, the U-shaped profile is formed as a square profile in the cross section.

A crimp area 160, which serves for receiving and crimping of litz wire in a manner that is per se known, is attached to the spring contacts 110, 130. Attached to the crimp area 160 is a strain relief 162, which [serves] for receiving an insulating cladding of a cable formed by litz wires.

The snap-in element 140 is attached to the U-shaped profile on the side that is facing away [from the] contact caps 111, 121 of the spring contacts 110, 120, for example it may be formed as an integral part of it. It can be made in a punching process from a flat metal sheet, which is bent at a right angle three times, initially for the purpose of forming the spring contacts 110, 120 and then for the purpose of forming the snap-in element 140 that is arranged above them in a lid-like manner. The snap-in element 140 comprises a beading 141 which extends throughout in the longitudinal direction and which serves the purpose of increasing the stability of the elongated snap-in element 140. At the front end that is facing the contact caps 111, 121, a locking hook 142 is formed at the snap-in element 140. Its function will be described in the following in more detail.

Figure 2:
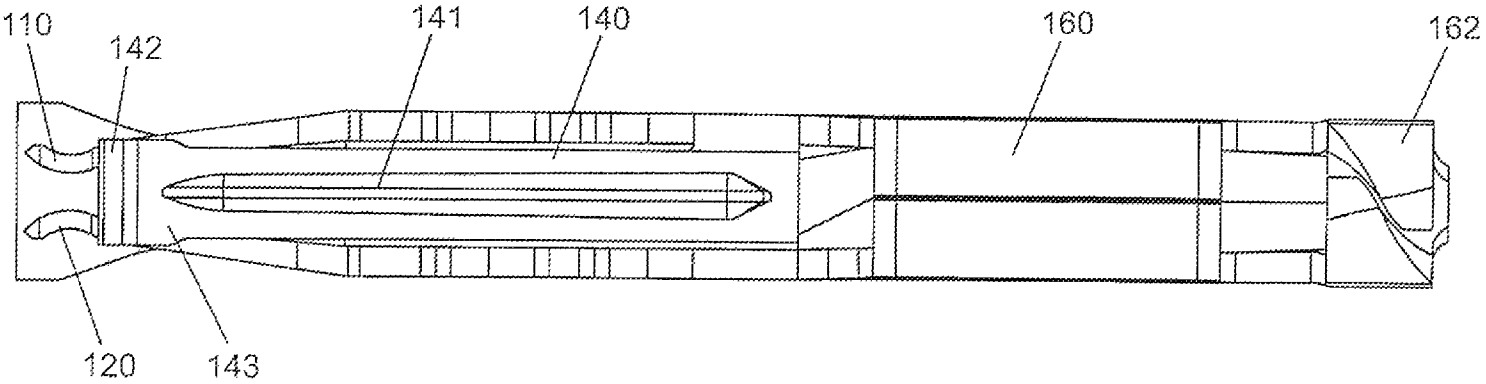
FIG. 2 is a top view of the spring contact element shown in FIG. 1.
Figure 3:
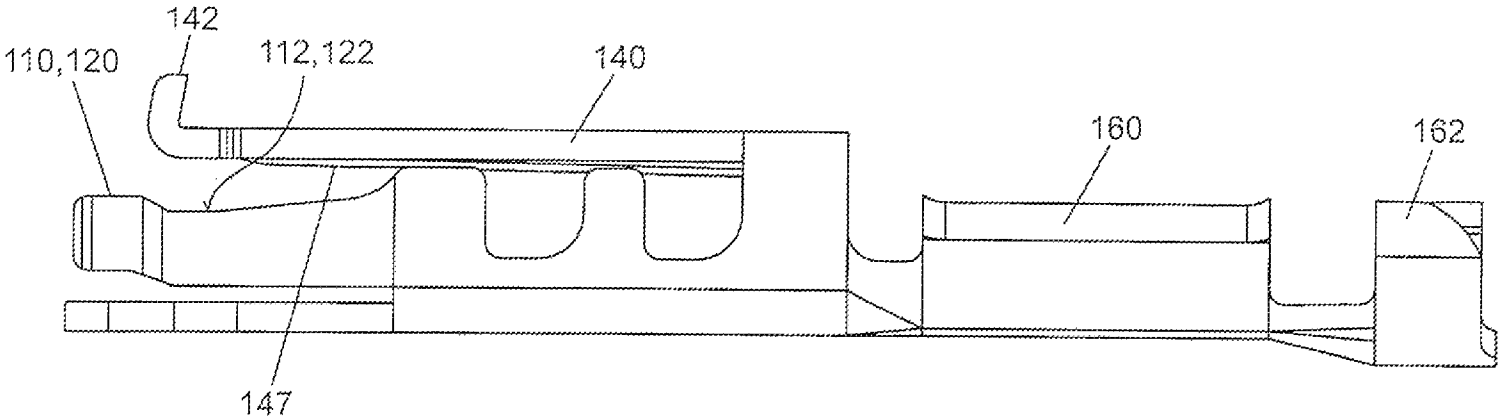
FIG. 3 is a side view of the spring contact element shown in FIGS. 1 and 2.

On their upper side, i.e. on the edge that is facing towards the snap-in element 140, the spring contacts 110, 120 have surfaces 112, 122 that run obliquely and that are formed as supporting surfaces for the snap-in element. As can particularly be seen in FIG. 2, but also in FIG. 1, the snap-in element 140 has a bending area 143 in the area of the locking hook 142, wherein that bending area 143 is formed so as to be wider than the snap-in element 140 itself. This serves the purpose of increasing the stability of the locking hook 142, and consequently also of increasing the extraction forces from the plug-in connector housing.

Figure 4:
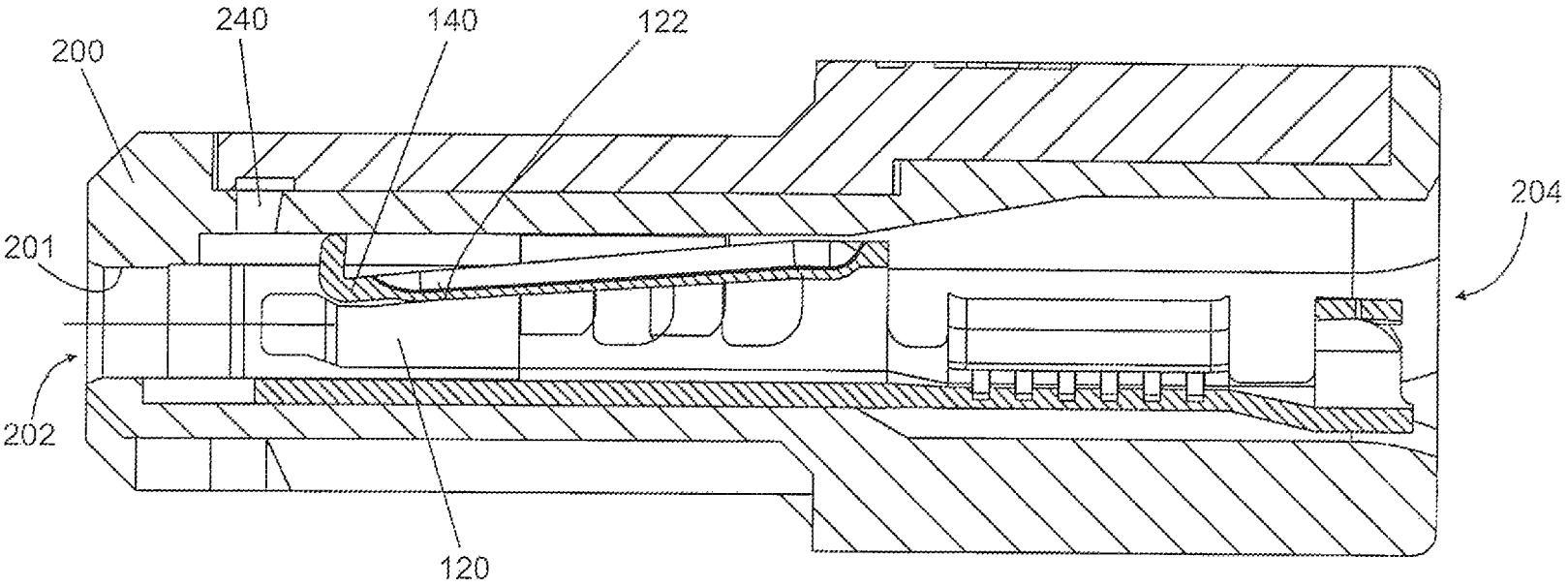
FIG. 4 shows a plug-in connector according to the invention in the non-latched state of the snap-in element.
Figure 5:
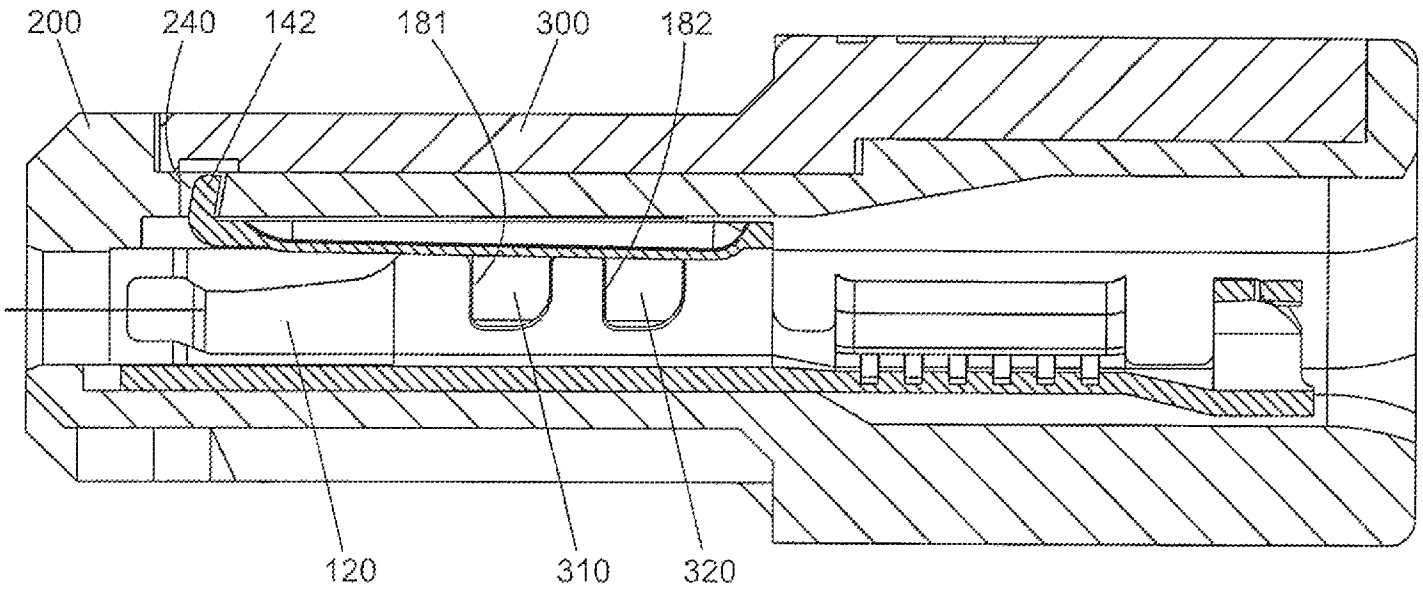
FIG. 5 shows a plug-in connector according to the invention in the latched state of the snap-in element.
Figure 6:
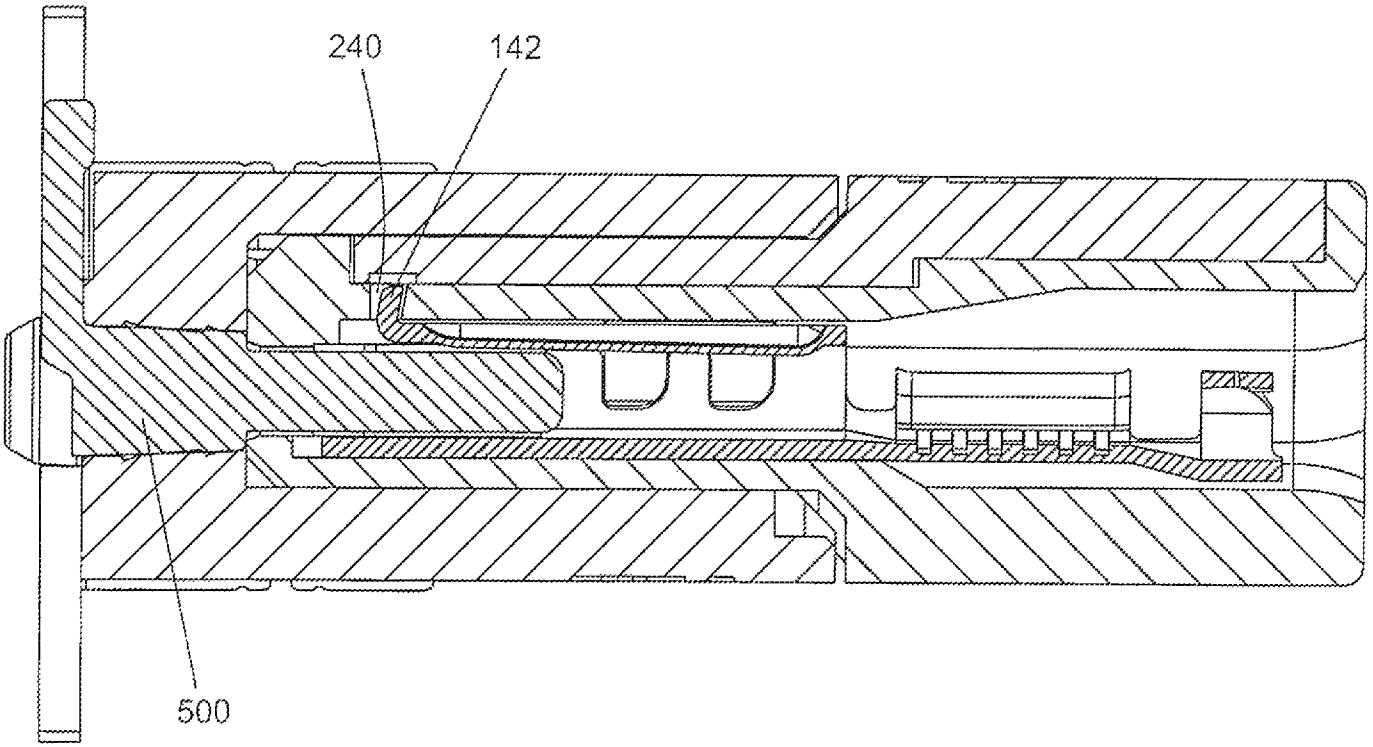
FIG. 6 shows the plug-in connector shown in FIG. 5 after the plug-in connection with a knife-blade contact element has been established.

FIG. 4 to FIG. 6 show a plug-in connector, and more specifically the arrangement of the spring contact element 100 described above inside a housing 200. FIG. 4 shows the snap-in element 140 in a state where it is not yet latched inside an opening 240 of the housing 200 provided for that purpose. As can be seen in FIG. 4, the electrical contact element in the form of the spring contact element 100 is arranged in a chamber 201 of the housing 200, which has an opening 202 on the side of the plug as well as an opening 204 on the side of the cable. The opening 202 located on the side of the plug serves for plugging-in the knife-blade contact element in a manner that is per se known, the opening 204 serves for guiding the cable (not shown) out from the housing 200. The spring contact element 100 is inserted into the housing 200 from the back side, i.e. from the opening 204, wherein the snap-in element 140 is not yet latched in the beginning. Instead, it is bent downwards and is resting on the supporting surfaces 112, 122. With it resting in that manner, the chances of the snap-in element 140 bending are limited, by which any damage that may be caused to the snap-in elements 140 through overbending is also avoided. After the spring contact element 100 has been completely inserted into the housing 200, a complete catching of the snap-in element 140 occurs. For this purpose, the locking hook 142 meshes with an opening 240 of the housing 200 that is provided for that purpose. That state is shown in FIG. 5.

After a knife-blade contact element 500 has been inserted into the spring contact element 100, as is schematically shown in FIG. 6, any unlatching of the snap-in element 140, i.e. any unlatching of the locking hooks 142 from the opening 240, is avoided in an effective and safe manner. That is to say, in that case the snap-in element 140 rests with its supporting surface 147, which is facing the knife-blade contact element 500, on the knife-blade contact element 500, so that any unlatching of the snap-in element is precluded in the plugged-in state. As is further shown in FIG. 4 to FIG. 6, such a plug-in connector may also have a secondary locking device 300 comprising locking cams 310, 320 that mesh into corresponding locking recesses 181, 182 of the spring contact element.

The invention claimed is:

1. Plug-in connector with a housing (200) and at least one chamber (201) for receiving at least one electrical contact element (100), which can be attached via a locking element inside the housing (200), wherein the locking element is a snap-in element (140) that is arranged on the at least one electrical contact element (100) and that can be locked in place in the housing (200) inside an opening (240) corresponding to the snap-in element, wherein the at least one contact element is a spring contact element, with the spring contacts (110, 120) of the contact element being formed as legs of a metal sheet that is bent into a U-shape, and wherein the snap-in element (140) is arranged in a lid-like manner above the metal sheet bent into a U-shape, in such a way that the snap-in element reaches the front area of the spring contacts (110, 120), wherein the snap-in element (140) has a locking hook (142), with a bending area (143) of the locking hook (142) being formed on the side of the spring contacts (110, 120) that is facing the opening.

2. Plug-in connector according to claim 1, wherein the bending area (143) is wider than the snap-in element (140).

3. Plug-in connector according to claim 1, wherein the snap-in element (140) has a beading (141) which substantially extends over its entire length.

4. Plug-in connector according to claim 1, wherein on their side that is facing the snap-in element (140), the spring contacts (110, 120) have obliquely extending supporting surfaces (112, 122) for the snap-in element (140) in the non-latched state.

5. Plug-in connector according to claim 1, wherein on its side that is facing the spring contacts (110, 120), the snap-in element (140) has a supporting surface (147) for a blade contact element (500).

6. Plug-in connector according to claim 1, wherein in the latched state, the snap-in element (140) is secured from unlocking by a secondary locking device (300) which is arranged on the housing (200).

7. Plug-in connector according to claim 1, wherein the spring contact element (100) and the snap-in element (140) are formed integrally with each other.

8. Plug-in connector according to claim 7, wherein the spring contact element (100) and the snap-in element (140) are formed from a single punched part.

* * * * *